US011588219B2

(12) United States Patent
Takahashi et al.

(10) Patent No.: US 11,588,219 B2
(45) Date of Patent: Feb. 21, 2023

(54) FEED PORTION FOR COUPLING TO A WAVEGUIDE FORMED IN A SUBSTRATE, WHERE THE FEED PORTION INCLUDES VIAS CONNECTED TO A CONNECTION PAD

(71) Applicant: NGK SPARK PLUG CO., LTD., Nagoya (JP)

(72) Inventors: Hiroyuki Takahashi, Nagoya (JP); Satoshi Hirano, Nagoya (JP); Naoko Mori, Nagoya (JP); Ikuro Aoki, Hachioji (JP); Takuya Adachi, Hachioji (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 13 days.

(21) Appl. No.: 17/276,617

(22) PCT Filed: Sep. 11, 2019

(86) PCT No.: PCT/JP2019/035706

§ 371 (c)(1),
(2) Date: Mar. 16, 2021

(87) PCT Pub. No.: WO2020/059595

PCT Pub. Date: Mar. 26, 2020

(65) Prior Publication Data

US 2022/0045414 A1 Feb. 10, 2022

(30) Foreign Application Priority Data

Sep. 18, 2018 (JP) ..... JP2018-173884

(51) Int. Cl.

| | |
|---|---|
| ***H01P 3/12*** | (2006.01) |
| ***H01P 5/103*** | (2006.01) |
| ***H01P 5/107*** | (2006.01) |

(52) U.S. Cl.
CPC ..... *H01P 3/121* (2013.01); *H01P 5/103* (2013.01); *H01P 5/107* (2013.01)

(58) Field of Classification Search
CPC ..... H01P 3/121; H01P 5/103
(Continued)

(56) References Cited

U.S. PATENT DOCUMENTS

| | | | | |
|---|---|---|---|---|
| 5,110,654 | A | 5/1992 | Yokokawa | |
| 8,552,815 | B2 * | 10/2013 | Fujii et al. | H01P 3/121 333/248 |

(Continued)

FOREIGN PATENT DOCUMENTS

| | | | |
|---|---|---|---|
| JP | H10-190320 | A | 7/1998 |
| JP | 3464108 | B2 | 11/2003 |
| JP | 2018-136273 | A | 8/2018 |

OTHER PUBLICATIONS

The State Intellectual Property Office of People's Republic of China, First Office Action issued in corresponding Application No. 201980060979.2 dated Aug. 4, 2021.

(Continued)

*Primary Examiner* — Benny T Lee
(74) *Attorney, Agent, or Firm* — Stites & Harbison, PLLC; Jeffrey A. Haeberlin; James R. Hayne

(57) ABSTRACT

A waveguide includes a dielectric substrate, a first conductor layer and a second conductor layer formed on a lower surface and an upper surface thereof, a pair of side wall parts forming side walls of both sides of the waveguide, and a feed part feeding an input signal to the waveguide. The feed part includes a feed terminal formed on the lower surface of the dielectric substrate and does not contact the first conductor layer, a first via conductor connected at a lower end thereof to the feed terminal, a first connection pad connected to an upper end of the first via conductor, and second via conductors that are each connected at a lower end thereof to the (Continued)

first connection pad. The sum of the cross-sectional areas of the second via conductors is greater than the sum of the cross-sectional area of the first via conductor.

11 Claims, 8 Drawing Sheets

(58) Field of Classification Search
USPC ..... 333/248, 26
See application file for complete search history.

(56) References Cited

U.S. PATENT DOCUMENTS

2011/0267152 A1 11/2011 Lee
2020/0056880 A1 2/2020 Wang et al.

OTHER PUBLICATIONS

Japan Patent Office, International Search Report issued in corresponding Application No. PCT/JP2019/035706 dated Oct. 29, 2019.
European Pattent Office, Supplementary European Search Report issued in corresponding Application No. 19863426.3 dated Apr. 20, 2022.

* cited by examiner (A)

(B)

(A)

(B)

(A)

(B)

(A)

(B)

(A)

(B)

(C)

FEED PORTION FOR COUPLING TO A WAVEGUIDE FORMED IN A SUBSTRATE, WHERE THE FEED PORTION INCLUDES VIAS CONNECTED TO A CONNECTION PAD

TECHNICAL FIELD

The present invention relates to a waveguide configured using a dielectric substrate including a plurality of dielectric layers stacked together.

BACKGROUND ART

In the field of radio communication performed through use of a high frequency signal in a microwave band or a millimeter wave band, heretofore, a waveguide has been widely known. The waveguide transmits a high frequency signal fed from a feed portion of the waveguide. In recent years, from the viewpoint of reduction in the size and weight and ease of machining, a waveguide configured using a dielectric substrate including a plurality of dielectric layers stacked together has been utilized. A waveguide of such a kind has, for example, a structure in which upper and lower conductor layers and groups of side via conductors are formed to surround the dielectric substrate, and a feed portion is formed at a predetermined position on the waveguide. In order to realize a waveguide having good transmission characteristics, it is necessary to suppress, to the extent possible, impedance mismatch in a region from a feed terminal of the feed portion to an interior portion of the waveguide. Therefore, there has been proposed a feed structure for a waveguide in which the diameter of a via conductor used for a feed portion formed in the waveguide is changed stepwise or continuously (see, for example, Patent Literature 1).

CITATION LIST

Patent Literature

Patent Literature 1: Japanese Patent No. 3464108, published Nov. 5, 2003.

SUMMARY OF INVENTION

Technical Problem

In the feed structure disclosed in Patent Literature 1 (see, for example, FIG. 1 of Patent Literature 1), the diameter of the via conductor for feed formed in the waveguide is the smallest on the side where the via conductor is connected to an external line or the like and increases stepwise toward the interior portion of the waveguide. In this case, in order to sufficiently mitigate a drastic change in impedance, the ratio between the maximum and minimum diameters of the via conductor for feed must be large. When a waveguide having the above-described feed structure is manufactured using a dielectric substrate, it is a common practice to form via holes, by means of punching, in a plurality of ceramic green sheets at a position corresponding to that of the via conductor for feed, fill the via holes with an electrically conductive metal paste, stack the ceramic green sheets, and fire the ceramic green sheets.

However, when the diameter of the via conductor for feed is excessively large, during firing, the dielectric substrate may warp or may crack in the vicinity of the via conductor for feed due to the difference in thermal expansion coefficient between the ceramic and the electrically conductive paste. Meanwhile, in the case where the maximum diameter of the via conductor for feed is restricted to such a degree that the above-described warpage and cracking can be prevented while the above-described ratio is maintained, since the minimum diameter of the via conductor for feed becomes excessively small, a filling failure may occur at that portion where the via conductor has the minimum diameter when the via holes are filled with the electrically conductive paste. In any case, manufacture-related various limitations are imposed on the ranges of the maximum and minimum diameters of the via conductor for feed, and setting dimensional conditions suitable for impedance matching has been difficult.

The present invention has been accomplished so as to solve the above-described problem and provides a waveguide which has a feed structure suitable for impedance matching and which can effectively prevent various problems, such as warpage, cracking, and filling failure, which would otherwise occur during manufacture of the waveguide.

Solution to Problem

In order to solve the above-described problem, the present invention provides a waveguide configured using a dielectric substrate including a plurality of dielectric layers stacked together. The waveguide includes a first conductor layer formed on a lower surface of the dielectric substrate, a second conductor layer formed on an upper surface of the dielectric substrate, a pair of side wall portions which electrically connect the first conductor layer and the second conductor layer to each other and form side walls of the waveguide on opposite sides, and a feed portion for supplying an input signal to the waveguide. The waveguide is characterized in that the feed portion includes a feed terminal formed on the lower surface of the dielectric substrate without contacting the first conductor layer; a single or plurality of first via conductors whose lower ends are connected to the feed terminal, a first connection pad connected to an upper end(s) of the single or plurality of first via conductors, and a plurality of second via conductors whose lower ends are connected to the first connection pad, wherein a sum total of cross-sectional areas of the plurality of second via conductors along the lower surface (XY plane) of the dielectric substrate is greater than a sum total of a cross-sectional area(s) of the single or plurality of first via conductors along the lower surface of the dielectric substrate.

According to the waveguide of the present invention, the feed portion for supplying the input signal to the waveguide configured using a dielectric substrate has a structure in which at least the feed terminal, the single or plurality of first via conductors, the first connection pad, and the plurality of second via conductors are connected in this order from the lower surface side of the dielectric substrate, and the sum total of the cross-sectional areas (along the lower surface of the dielectric substrate) of the plurality of second via conductors on the upper side is greater than that of the single or plurality of first via conductors near the feed terminal. By virtue of such a feed structure, a drastic change in impedance can be mitigated to realize a sufficient degree of impedance matching by appropriately adjusting the number of the first via conductor(s) and the number of the second via conductors without increasing the ratio between the diameter of the first via conductor(s) and the diameter of the second via conductors. Since it is unnecessary to increase or decrease the diameters of the via conductors drastically, at the time of manufacture of the waveguide, it is possible to prevent warpage and cracking of the dielectric substrate, which would otherwise occur due to a difference in coefficient of thermal expansion produced when the diameters of the via conductors are extremely large, and it is possible to prevent occurrence of a failure in filling of an electrically conductive paste, which would otherwise occur when the diameters of the via conductors are extremely small.

In the feed portion of the present invention, the number of the plurality of second via conductors may be set to be greater than the number of the single or plurality of first via conductors. Thus, the sum total of cross-sectional areas of the plurality of second via conductors can be easily rendered larger than the sum total of the cross-sectional area(s) of the single or plurality of first via conductors. In this case, it is possible to form all the single or plurality of first via conductors and the plurality of second via conductors by circular columnar conductors having the same diameter.

In the feed portion of the present invention, it is desired that the plurality of second via conductors be arranged at intervals equal to or smaller than ½ of a cutoff wavelength. In this case, the plurality of second via conductors may be arranged along a circle in a plane of the first connection pad.

Furthermore, the feed portion of the present invention may be configured such that a second connection pad and a plurality of third via conductors are alternatingly connected above the plurality of second via conductors along a height direction of the dielectric substrate, and a sum total of cross-sectional areas, along the lower surface of the dielectric substrate, of a plurality of via conductors including the single or plurality of first via conductors, the plurality of second via conductors, and the plurality of third via conductors increases stage by stage toward an upper side in the height direction. Therefore, the sum total of the cross-sectional areas of the plurality of via conductors of each layer can be readily adjusted in accordance with, for example, the set number of the plurality of via conductors of each layer, whereby a drastic change in impedance in a region from the feed portion to an interior portion of the waveguide can be mitigated without fail.

Even in the case where the feed portion of the present invention has a structure in which the above-described second connection pad and the above-described third via conductors are connected alternatingly, it is possible to set the number of the plurality of via conductors to increase stage by stage toward the upper side in the height direction. In this case, it is possible to form all the via conductors by circular columnar conductors having the same diameter. Also, it is desired that the plurality of third via conductors whose lower ends are connected to the common second connection pad be arranged at intervals equal to or smaller than ½ of a cutoff wavelength. In this case, the plurality of third via conductors may be arranged along a circle in a plane of the second connection pad. Moreover, in a plan view as viewed in the height direction, all the connection pads including the first connection pad and the second connection pad may be formed to be located at the same position and have circular shapes having the same diameter.

The pair of side wall portions of the present invention may be configured using a plurality of via conductors for side walls each of which connects the first conductor layer and the second conductor layer to each other. By virtue of this, the plurality of via conductors contained in the feed portion and the plurality of via conductors for side walls contained in the pair of side wall portions can be formed by the same method, whereby the manufacturing efficiency of the waveguide can be increased.

Advantageous Effects of Invention

According to the present invention, the feed portion has a structure in which the single or plurality of first via conductors connected to the upper surface of the feed terminal and the plurality of second via conductors connected to the first connection pad are connected sequentially, and the sum total of the cross-sectional areas of the plurality of second via conductors is greater than the sum total of the cross-sectional area(s) of the single or plurality of first via conductors. Therefore, it is possible to mitigate a drastic change in impedance in the region from the feed terminal to the interior portion of the waveguide by appropriately adjusting the number of the first via conductor(s) and the number of the second via conductors, without excessively increasing or decreasing the via diameters. At the time of manufacture of the waveguide, it is possible to prevent occurrence of warpage and cracking of the dielectric substrate, which would otherwise occur when the diameters of the via conductors are excessively large, and it is possible to prevent occurrence of a filling failure, which would otherwise occur when the diameters of the via conductors are excessively small. Therefore, it is possible to realize a waveguide in which impedance is matched to a sufficient degree and which has good transmission characteristics, without impairing reliability at the time of manufacture.

DESCRIPTION OF EMBODIMENTS

A preferred embodiment of a waveguide to which the present invention is applied will now be described with reference to the attached drawings. However, the embodiment which will be described below is an example of a mode in which the technical idea of the present invention is embodied, and the present invention is not limited by the contents of the present embodiment.

Figure 1:
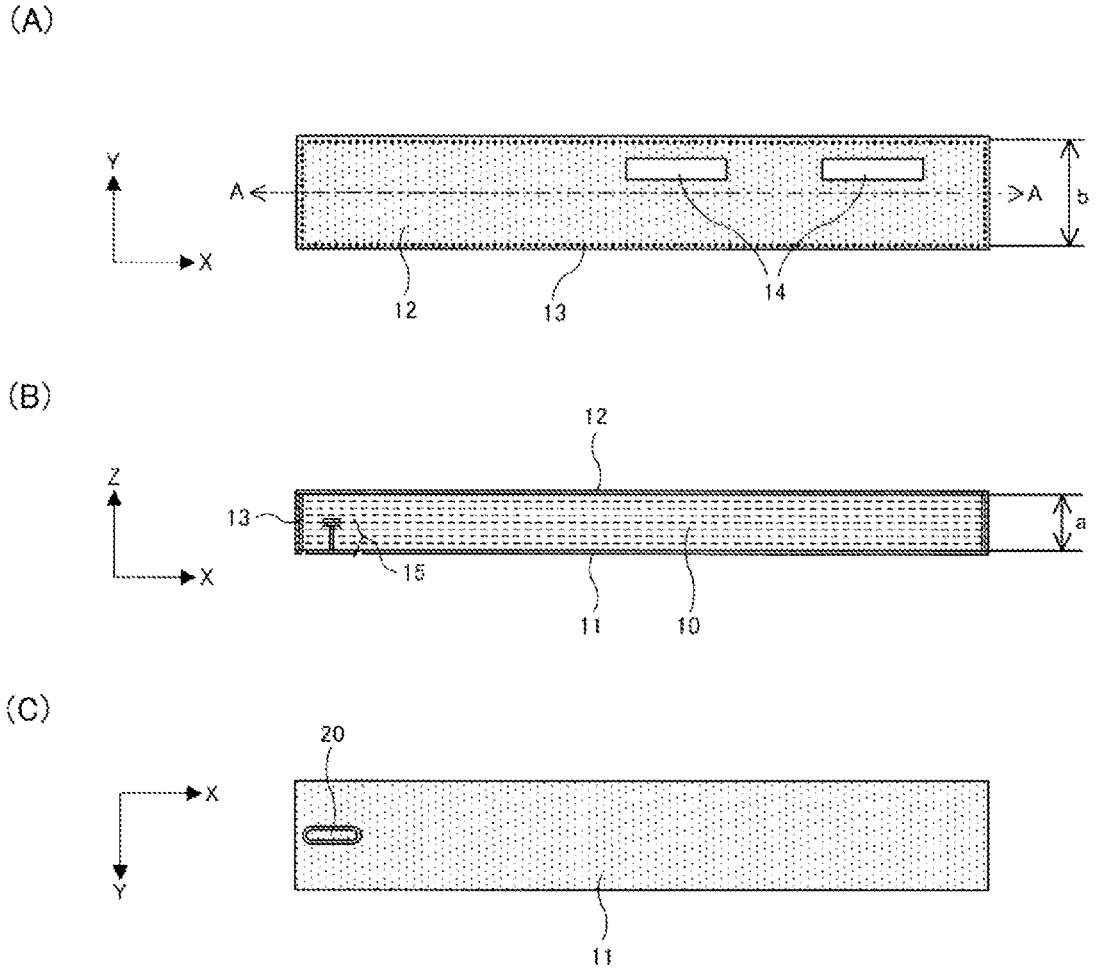
FIG. 1 Views showing an example of the structure of a waveguide to which the present invention is applied, wherein (A) in FIG. 1 is a top view of the waveguide, (B) in FIG. 1 is a sectional view of the waveguide of (A) in FIG. 1 taken along line A-A, and (C) in FIG. 1 is a bottom view of the waveguide of (A) in FIG. 1(A).

First, an example of the structure of the waveguide to which the present invention is applied will be described with reference to FIG. 1. (A) in FIG. 1 is a top view of the waveguide of the present embodiment, (B) in FIG. 1 is a sectional view of the waveguide of (A) in FIG. 1 taken along line A-A, and (C) in FIG. 1 is a bottom view of the waveguide of (A) in FIG. 1. Notably, in FIG. 1, for convenience of description, an X direction (the tube axis direction of the waveguide), a Y direction, and a Z direction, which are orthogonal to one another, are shown by respective arrows.

The waveguide shown in FIG. 1 includes a dielectric substrate 10 made of a dielectric material such as a ceramic material, a conductor layer 11 (the first conductor layer of the present invention) formed on the lower surface of the dielectric substrate 10 and made of an electrically conductive material, a conductor layer 12 (the second conductor layer of the present invention) formed on the upper surface of the dielectric substrate 10 and made of an electrically conductive material, a plurality of via conductors 13 (the via conductors for side walls of the present invention) for establishing connection between the upper and lower conductor layers 11 and 12, two slots 14 formed in the upper conductor layer 12, and a feed portion 15 formed in a lower region of the waveguide. As shown in (C) of FIG. 1, a feed terminal 20 at the lower end of the feed portion 15 is separated from (is not in contact with) the surrounding conductor layer 11 and has an outer shape whose longitudinal direction coincides with the X direction, as further discussed below.

The dielectric substrate 10 is formed by stacking a plurality of dielectric layers, has a rectangular parallelepiped shape, and its longitudinal direction coincides with the X direction. Along the circumference of the dielectric substrate 10, the upper and lower sides (opposite sides in the Z direction) are covered with the above-described pair of conductor layers 11 and 12, and all four sides in the XY plane are surrounded by the above-described plurality of via conductors 13. Such a structure enables the dielectric substrate 10 to function as a waveguide surrounded by conductor walls composed of the pair of conductor layers 11 and 12 and the plurality of via conductors 13. This waveguide transmits a signal in the X direction, which is the tube axis direction. As shown in (A) and (B) in FIG. 1, the waveguide has a rectangular cross section (YZ cross section) having a height a in the Z direction and a width b in the Y direction. In general, the height a and the width b are set to satisfy a relation of b 2*a*. By virtue of such setting, a signal can be propagated in the main mode (TE10) in which the upper and lower surfaces of the waveguide serve as H-planes.

The plurality of via conductors 13 are columnar conductors formed by filling a plurality of through holes penetrating the dielectric substrate 10 with an electrically conductive material and each establish electrical connection between the upper and lower conductor layers 11 and 12. The plurality of via conductors 13 are arranged such that an interval between adjacent via conductors 13 becomes equal to or smaller than ½ of a cutoff wavelength of the waveguide. Two rows of via conductors 13 arranged along the X direction (the pair of side wall portions of the present invention) constitute side walls of the waveguide facing each other in the Y direction, and two rows of via conductors 13 arranged along the Y direction constitute a pair of end faces of the waveguide facing each other in the X direction. Notably, the plurality of via conductors 13 are not exposed to the outside and their outer circumferences are covered by the dielectric substrate 10.

Notably, in the example of FIG. 1, there is shown a structure in which the plurality of via conductors 13 define the four sides of the waveguide as viewed in the Z direction. In actuality, the waveguide may have a structure in which the plurality of via conductors 13 define only two sides corresponding to the side walls on the opposite sides which face each other in the Y direction. Notably, in place of the plurality of via conductors 13, a side wall made of an electrically conductive material may be formed on each of four or two side surfaces of the outer circumference of the dielectric substrate 10.

The two slots 14 are disposed on the upper conductor layer 12 at a predetermined position and at a predetermined pitch, and function as an antenna of the waveguide. At the position of each slot 14, an opening is formed in the conductor layer 12, and the dielectric substrate 10 located underneath is partially exposed. In the example of FIG. 1, the two slots 14, which have the same length (dimension in the X direction) and the same width (dimension in the Y direction), are juxtaposed to each other at a position deviated from the center position in the Y direction. The length (dimension in the X direction) of the slots 14 is appropriately set in accordance with a desired frequency characteristic. Notably, in FIG. 1, there is shown a structure in which the waveguide has the slots 14. However, the present invention can be applied to a waveguide which does not have the slots 14.

Figure 2:
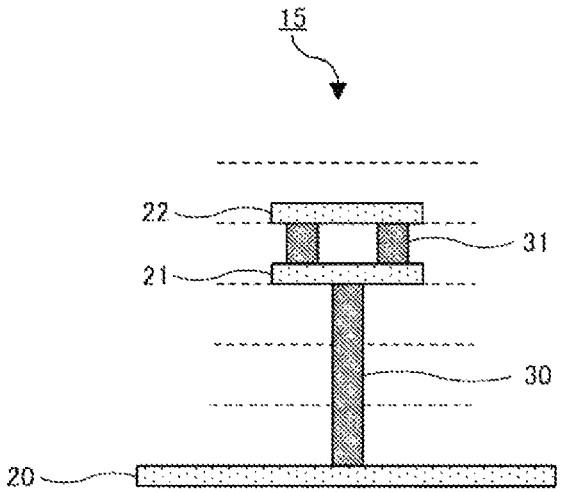
FIG. 2 Views showing the structure of a feed portion 15 of FIG. 1, wherein (A) in FIG. 2 is a side view showing the feed portion 15 on an enlarged scale, and (B) in FIG. 2 is a plan view of connection pads 21 and 22 as viewed in the Z direction.
Figure 2:
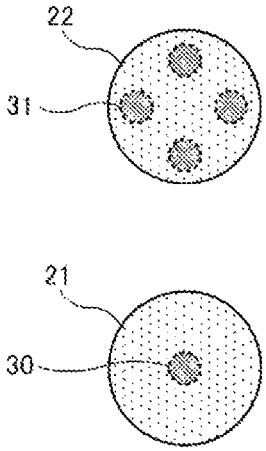

The feed portion 15 plays a role of supplying an external input signal to the waveguide. Hereinafter, the structure of the feed portion 15 will be described in detail with reference to FIG. 2. (A) in FIG. 2 is a side view showing, on an enlarged scale, the feed portion 15 shown in (B) in FIG. 1, and (B) in FIG. 2 includes plan views of connection pads 21 and 22 of the feed portion 15 as viewed in the Z direction. Notably, in (B) in FIG. 2, a single via conductor 30 located directly under the connection pad 21 and four via conductors 31 located directly under the connection pad 22 are shown in a state in which the via conductors 30 and 31 are seen through the connection pads 21 and 22, respectively.

As shown in FIG. 2, the feed portion 15 of the present embodiment is composed of a feed terminal 20 composed of a conductor pattern formed in the same plane as the conductor layer 11, the connection pad 21 (the first connection pad of the present invention) disposed above the feed terminal 20, the connection pad 22 (the second connection pad of the present invention) disposed above the connection pad 21, the single via conductor 30 (the single or plurality of first via conductors of the present invention) which electrically connects the feed terminal 20 to the connection pad 21, and the four via conductors 31 (the plurality of second via conductors of the present invention) which electrically connect the connection pad 21 to the connection pad 22.

As shown in (C) in FIG. 1, the feed terminal 20 at the lower end of the feed portion 15 is separated from (is not in contact with) the surrounding conductor layer 11 and has an outer shape whose longitudinal direction coincides with the X direction. One end of a line for transmitting, for example, an input signal generated by an electronic circuit or the like is connected to the feed terminal 20. As shown in (A) in FIG. 2, a lower end of the single via conductor 30 is connected to an upper surface of the feed terminal 20. The via conductor 30 is formed to penetrate lower-side three dielectric layers of the dielectric substrate 10, and an upper end of the via conductor 30 is connected to the connection pad 21. Respective lower ends of the four via conductors 31 are connected an upper surface of the connection pad 21. The four via conductors 31 are formed to penetrate a dielectric layer of the dielectric substrate 10 located at a predetermined position, and respective upper ends of the four via conductors 31 are connected to the connection pad 22. Therefore, the input signal supplied to the waveguide through the feed portion 15 is transmitted through the interior of the waveguide via the feed terminal 20, the single via conductor 30, the connection pad 21, the four via conductors 31, and the connection pad 22 in this order.

As shown in (B) FIG. 2, in a plan view as viewed in the Z direction, the connection pads 21 and 22 are located at the same position and have circular shapes having the same diameter. The single via conductor 30 is located at the center of the circle in the plane of the connection pad 21. Meanwhile, the four via conductors 31 are circumferentially arranged around the center of the circle in the plane of the connection pad 22. Also, as in the case of the plurality of via conductors 13 (FIG. 1) constituting the side walls, the four via conductors 31 are arranged such that an interval between adjacent via conductors 31 becomes equal to or smaller than ½ of the cutoff wavelength. Notably, the via conductors 30 and 31 which are contained in the feed portion 15 and the total number of which is 5 have respective circular cross sections having the same diameter in the XY plane. Therefore, the sum total of the cross-sectional areas (in the XY plane) of the four via conductors 31 on the upper side is four times that of the single via conductor 30 on the lower side.

The feed portion 15 having the above-described structure has a role of suppressing impedance mismatch which occurs when a signal is supplied to the waveguide via the feed portion 15. Namely, whereas an external conductor, such as a line, connected to the feed terminal 20 of the feed portion 15 normally has an impedance of about 50Ω, the waveguide has a large impedance of at least about 100 to 200Ω depending the dielectric constant of the dielectric substrate 10. Therefore, in general, if an impedance mismatch occurs due to the feed portion 15, the transmission characteristics of the waveguide may deteriorate because of reflection of the signal or the like. Meanwhile, the feed portion 15 of the present embodiment has a structure in which the feed portion 15 has a small cross-sectional area in the vicinity of the external conductor and the cross-sectional area increases in the interior portion of the waveguide. Therefore, it is possible to mitigate a drastic change in impedance, thereby realizing impedance matching without fail. Furthermore, the feed portion 15 of the present embodiment is advantageous in the point that, unlike a conventional feed structure (For example, the feed structure of Patent Literature 1), a defect stemming from a manufacturing process of the waveguide composed of the dielectric substrate 10 can be prevented. This point will be described in detail later.

The structure of the feed portion 15 of the present embodiment is not limited to the structure shown in FIG. 1 and FIG. 2, and various modifications are possible, provided that the effects of the present invention are achieved. First, even when the feed portion 15 shown in FIG. 1 and FIG. 2 has a structure in which the uppermost connection pad 22 is not provided, the above-described action and effects can be realized mostly. However, in an ordinary structure, the upper ends of the plurality of via conductors 31 are connected to a certain connection pad in the process of manufacturing the waveguide. Therefore, the connection pad 22 is provided. Also, the feed portion 15 shown in FIG. 1 and FIG. 2 has a structure in which only the single via conductor 30 is provided on the lower side. However, even when the feed portion 15 has a structure in which a plurality of via conductors 30 are provided on the lower side, the present invention can be applied if the sum total of the cross-sectional areas of the plurality of via conductors 30 is smaller than the sum total of the cross-sectional areas of the plurality of via conductors 31 on the upper side. As described above, the feed portion 15 to which the present invention can be applied can be realized when the feed portion 15 includes the feed terminal 20, the single or plurality of via conductors 30, the connection pad 21, and the plurality of via conductors 31.

Figure 3:
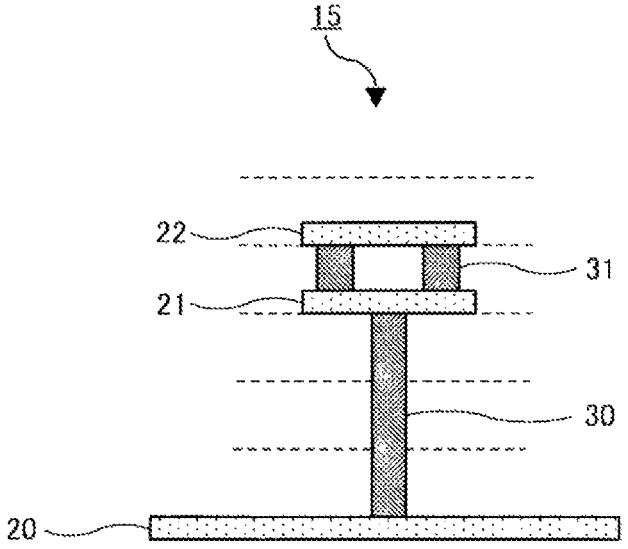
FIG. 3 Views showing a modification regarding the number of via conductors 31 of the feed portion 15, wherein (A) in FIG. 3 is a side view showing the feed portion 15 on an enlarged scale, and (B) in FIG. 3 is a plan view of connection pads 21 and 22 as viewed in the Z direction.
Figure 3:
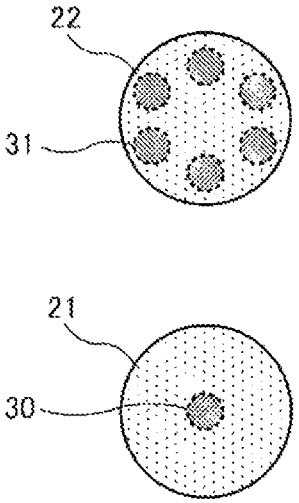

Here in below, representative modifications of the feed portion 15 of the present embodiment will be described using FIG. 3 to FIG. 5. Notably, in each of FIG. 3 to FIG. 5, a side view corresponding to (A) in FIG. 2 and a plan view corresponding to (B) in FIG. 2 are shown for description. First, FIG. 3 shows a modification regarding the number of the via conductors 31 of the feed portion 15. In the present modification, the feed terminal 20, connection pads 21, 22, and the single via conductor 30 which electrically connects the feed terminal 20 to the connection pad 21 are substantially the same as shown and described above with respect to FIG. 2, but the four via conductors 31 of (B) in FIG. 2 are replaced with six via conductors 31 as shown in (B) in FIG. 3. These six via conductors 31 are circumferentially arranged around the center of a circle in the plane of the connection pad 21. In the present embodiment, the number of the via conductors 30 and the number of the via conductors 31 can be determined appropriately in accordance with the impedance characteristic of the feed portion 15. In this case, the number of the plurality of via conductors 30 or 31 in each stage normally increases toward the upper side in the Z direction. However, a case in which the number does not increase is assumed so long as the sum total of the cross-sectional areas increases.

Figure 4:
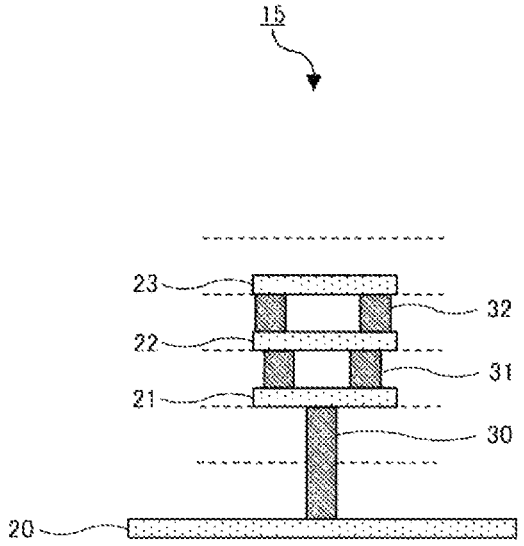
FIG. 4 Views showing a modification regarding the structure of an upper portion of the feed portion 15, wherein (A) in FIG. 4 is a side view showing the feed portion 15 on an enlarged scale, and (B) in FIG. 4 is a plan view of connection pads 21, 22, and 23 as viewed in the Z direction.
Figure 4:
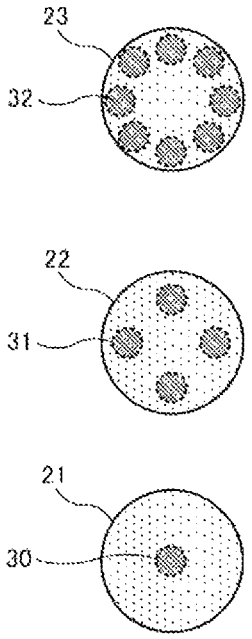

FIG. 4 shows a modification regarding the structure of an upper portion of the feed portion 15. In the present modification, the feed terminal 20, connection pads 21, 22, the single via conductor 30 which electrically connects the feed terminal 20 to the connection pad 21, and the four via conductors 31 which electrically connect the connection pad 21 to the connection pad 22 are substantially the same as shown and described above with respect to FIG. 2, but respective lower ends of eight via conductors 32 (the plurality of third via conductors of the present invention) shown in (B) in FIG. 4 are connected to an upper surface of the connection pad 22 of FIG. 2, and respective upper ends of the eight via conductors 32 are connected to a connection pad 23 (the second connection pad of the present invention). In the example of FIG. 4, in a plan view as viewed in the Z direction, the connection pad 23 is located at the same position as the connection pads 21 and 22 and has a circular shape having the same diameter as the connection pads 21 and 22, and the eight via conductors 32 are circumferentially arranged around the center of a circle in the plane of the connection pad 22.

Although not illustrated in FIG. 4, the feed portion 15 may have a structure in which a plurality of via conductors and a connection pad are alternatingly connected above the connection pad 23. Namely, the present invention can be applied to a structure in which a predetermined number of stages each including a plurality of via conductors and a connection pad are disposed above the feed terminal 20 within the structure of the feed portion 15. In this case, the sum total of the cross-sectional areas of the plurality of via conductors in each stage must be increased toward the upper side in the Z direction. Notably, in the example of FIG. 4, the connection pads 21 to 23 are located at the same position and have circular shapes having the same diameter. However, the connection pads in the respective stages may be located at different positions and have different outer shapes. Also, the arrangement of the plurality of via conductors in each stage is not limited to the circumferential arrangement, and the plurality of via conductors in each stage may be arranged in any of various patterns. Moreover, the height (the length in the Z direction) of the single via conductor or the plurality of via conductors in each stage is not limited to those in the examples of FIG. 2 to FIG. 5 and can be determined appropriately in accordance with the impedance characteristic of the feed portion 15.

Figure 5:
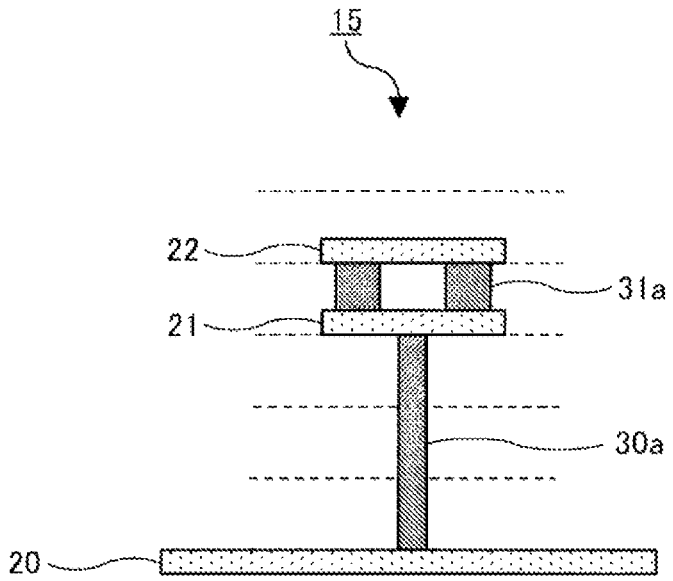
FIG. 5 Views showing a modification regarding the diameters of via conductors contained in the feed portion 15, wherein (A) in FIG. 5 is a side view showing the feed portion 15 on an enlarged scale, and (B) in FIG. 5 is a plan view of connection pads 21 and 22 as viewed in the Z direction.
Figure 5:
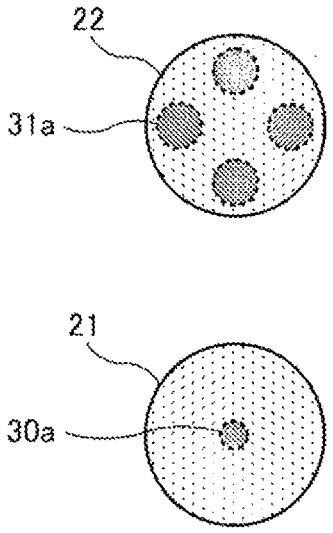

FIG. 5 shows a modification regarding the diameters of the via conductors contained in the feed portion 15. In the present modification, the feed terminal 20, connection pads 21, 22 are substantially the same as shown and described above with respect to FIG. 2, but as shown in (B) in FIG. 5, the single via conductor 30 shown in (B) in FIG. 2 is replaced with a single via conductor 30*a* having a smaller diameter, and the four via conductors 31 shown in (B) in FIG. 2 are replaced with four via conductors 31*a* having a larger diameter. Notably, the plurality of via conductors contained in the feed portion 15 are not required to have the same diameter, and via conductors having different diameters may be present in a mixed manner. However, as will be described later, in consideration of problems involved in manufacture of the waveguide, the dimeter of each via conductor is restricted to a range of 50 μm to 200 μm, inclusive, and it is desired to decrease, to a possible extent, the difference in diameter between via conductors having different diameters within the range. Notably, a case where the diameter of the via conductors decreases on the upper side in the Z direction is assumed. Even in such a case, however, as described above, the sum total of the cross-sectional areas of the plurality of via conductors in each stage must be increased toward the upper side in the Z direction.

Figure 6:
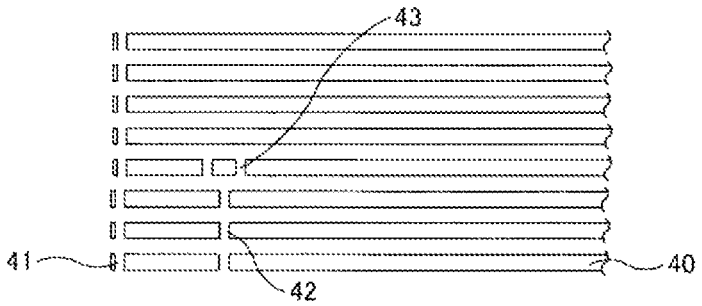
FIG. 6 Views used for describing the outline of a method for manufacturing the waveguide of the present embodiment, wherein (A) in FIG. 6 illustrates via holes formed in ceramic green sheets, (B) in FIG. 6 illustrates via conductors formed by filling the via holes, and (C) in FIG. 6 illustrates conductor layers and conductor pads formed by screen printing.
Figure 6:
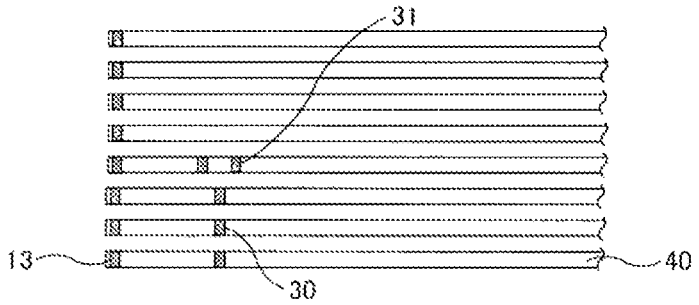
Figure 6:
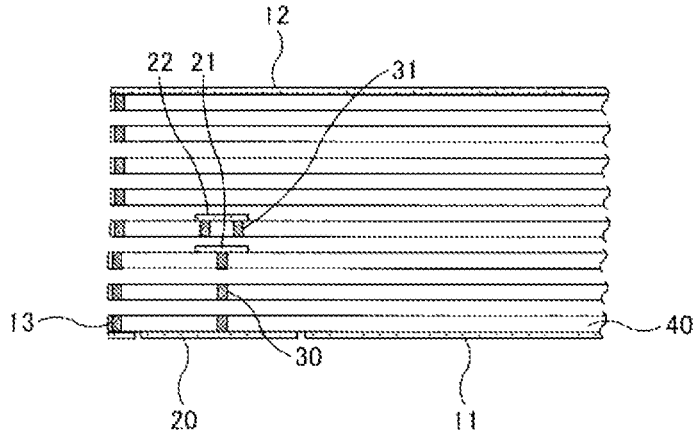

Next, the outline of a method for manufacturing the waveguide of the present embodiment will be described with reference to FIG. 6. FIG. 6 shows a sectional structure of only a region of the structure of FIG. 1, the region being mainly located on the left side in the X direction. First, a plurality of ceramic green sheets 40 for low-temperature firing formed by, for example, a doctor blade method are prepared as a plurality of dielectric layers for constituting the dielectric substrate 10. Here, it is assumed that eight ceramic green sheets 40 corresponding to the dielectric layers shown in (B) in FIG. 1 are used. Subsequently, as shown in (A) in FIG. 6, punching is performed at predetermined positions of each ceramic green sheet 40, thereby forming via holes 41 corresponding to the plurality of via conductors 13 (shown in (A) and (B) in FIG. 1) for the side walls, and via holes 42 and 43 corresponding to the plurality of via conductors 30 and 31 (shown in (A) and (B) in FIG. 2) for the feed portion 15. Notably, although the via holes 41 for the side walls are not shown in FIG. 6, the via holes 41 are disposed along the four sides of the waveguide in a plan view.

Next, as shown in (B) in FIG. 6, the plurality of via conductors 13 for the side walls and the plurality of via conductors 30 and 31 of the feed portion 15 are respectively formed by filling the plurality of via holes 41, 42, and 43 formed in the ceramic green sheets 40 with an electrically conductive paste containing Cu by means of screen printing. Subsequently, as shown in (C) in FIG. 6, the upper and lower conductor layers 11 and 12, the feed terminal 20, and the connection pads 21 and 22 are respectively formed by applying the above-described electrically conductive paste, by screen printing, to an upper surface of the uppermost ceramic green sheet 40, a lower surface of the lowermost ceramic green sheet 40, and upper surfaces of the ceramic green sheets 40 at predetermined positions.

Subsequently, the plurality of ceramic green sheets 40 having undergone the above-described process are sequentially stacked, and the stacked ceramic green sheets 40 are heated and pressed, whereby a laminate is formed. Subsequently, the obtained laminate is subjected to debindering and firing, whereby a waveguide configured in the dielectric substrate 10 having the structure shown in FIG. 1 is completed.

Figure 7:
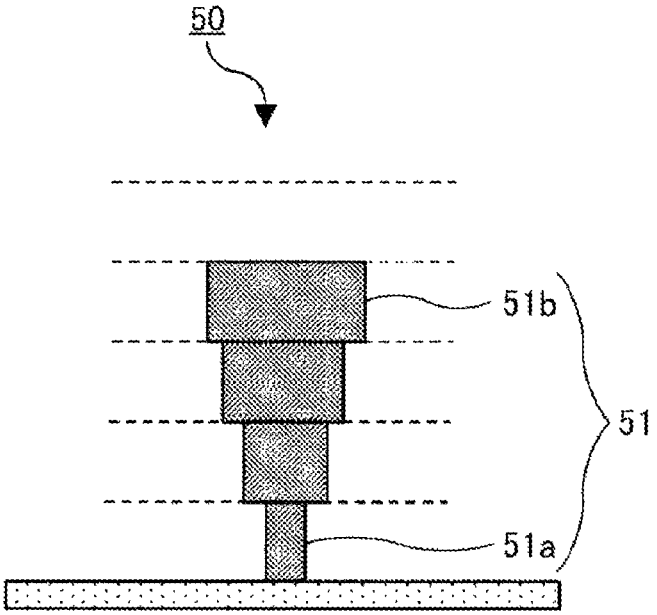
FIG. 7 (CONVENTIONAL ART)
FIG. 7 View showing an example of the sectional structure of a conventional feed portion 50 for comparison with the present embodiment.

An effect which is obtained in the manufacturing process having been described with reference to FIG. 6 because of employment of the structure of the feed portion 15 of the present embodiment will now be described. FIG. 7 shows an example of the sectional structure of a conventional feed portion 50 (see, for example, FIG. 2 of Patent Literature 1) for comparison with the present embodiment. Unlike the feed portion 15 of the present embodiment shown in (A) in FIG. 2, the feed portion 50 of FIG. 7 is configured such that the diameter of a via conductor 51 connected to a feed terminal is increased stepwise toward the upper side in order to mitigate a drastic change in impedance. For example, the diameter of an upper end portion 51*b* of the via conductor 51 is about several times the diameter of a lower end portion 51*a* of the via conductor 51.

It is assumed that the upper end portion 51*b* of the via conductor 51 of FIG. 7 is formed in the same manner as that show in (B) in FIG. 6. In this case, when an electrically conductive paste is provided into a via hole corresponding to the upper end portion 51*b* and a formed laminate is fired, a thermal stress acts on the vicinity of the upper end portion 51*b* because of the difference in coefficient of thermal expansion between the electrically conductive metal paste and the surrounding ceramic green sheet 40. At that time, no problem occurs in the case where the diameters of the via conductors 30 and 31 are small as in the present embodiment. However, in the case of the conventional feed portion 50, since the upper end portion 51*b* of FIG. 7 has a large diameter, the influence of the thermal stress is strong, so that the possibility of occurrence of partial warpage of the laminated substrate and/or cracking increases.

Meanwhile, in order to avoid the above-described problem, the diameters of the via conductor 51 can be reduced at the same ratio such that the diameter of the upper end portion 51*b* decreases to some extent. However, in this case, since the diameter of the lower end portion 51*a* becomes smaller, a filling failure becomes more likely to occur when the lower end portion 51*a* is filled with the electrically conductive paste, and the via conductor 51 may become incomplete. As described above, in the case of the conventional feed portion 50, various problems associated with manufacture of the waveguide occur and reliability can not be secured. In contrast, in the case of the feed portion 15 of the present embodiment, such problems do not occur, and high reliability can be secured.

Figure 8:
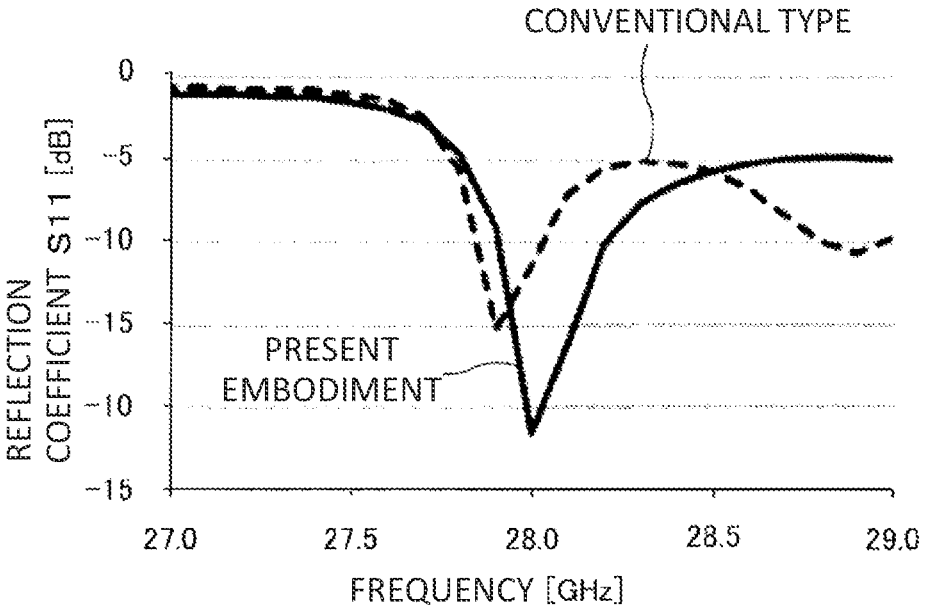
FIG. 8 Graph used for describing the frequency characteristic of the waveguide of the present embodiment obtained through a simulation while comparing with that of a waveguide having the conventional feed portion 50.

Next, the frequency characteristic of the waveguide of the present embodiment obtained through a simulation will be described. FIG. 8 schematically showing, in a superimposed manner, the frequency characteristic (a change in reflection coefficient S11 in dB in a predetermined frequency range in GHz) of the waveguide having the feed portion 15 described in the present embodiment and the frequency characteristic of a waveguide including the conventional feed portion 50 shown in FIG. 7. In the simulation of FIG. 8, the frequency range was set to 27 GHz to 29 GHz, the dimensions a and b in FIG. 1 were set to 1.6 mm and 3.2 mm, respectively, the relative permittivity a of the dielectric substrate 10 was set to 5.8, the dielectric loss tan δ of the dielectric substrate 10 was set to 0.0022, and it was assumed that the conductor layers 11 and 12, the via conductors 13, and the feed portions 15 and 50 are perfect conductors. Also, the simulation was executed under the condition that the diameter of the via conductors 30 and 31 of the feed portion 15 of the present embodiment is ϕ0.1 mm, the smallest via pitch of the via conductors 13 is 0.2 mm, and the diameters of the via conductor 51 of the conventional feed portion 50 are ϕ0.1 mm, ϕ0.2 mm, ϕ0.3 mm, and ϕ0.4 mm in this order from the lower layer side.

As shown in FIG. 8, the frequency characteristic of the waveguide of the present embodiment has an attenuation pole near a frequency of 28 GHz, which demonstrates that a sufficiently wide frequency band is obtained. Meanwhile, the frequency characteristic of the waveguide having the conventional structure has an attenuation pole at a frequency slightly lower than 28 GHz, which means that its frequency band is narrower than that of the waveguide of the present embodiment. As described above, the frequency characteristic can be improved; i.e., the frequency band can be expanded, through employment the structure of the feed portion 15 of the present embodiment.

Although the contents of the present invention have been specifically described on the basis of the present embodiment above, the present invention is not limited to the above-described embodiment, and various modifications can be made without departing from the gist of the invention. Namely, the structure of the waveguide of the present embodiment and the structure of the feed portion 15 are not limited to the structural examples having been described with reference to FIG. 1 to FIG. 5, and the present invention can be widely applied to various waveguides which use other structures and/or materials, so long as the action and effects of the present invention are achieved. Moreover, in other points, the contents of the present invention are not limited by the above-described embodiment, and the present invention is not limited to the contents disclosed in the above-described embodiment and can be changed appropriately, so long as the action and effects of the present invention are achieved.

REFERENCE SIGNS LIST

10: dielectric substrate
11, 12: conductor layers
13: via conductors (for side walls)
14: slot
15: feed portion
20: feed terminal
21, 22, 23: connection pads
30, 31, 32: via conductors
40: ceramic green sheet
41, 42, 43: via holes

What is claimed is:

1. A waveguide configured using a dielectric substrate including a plurality of dielectric layers stacked together, characterized in that the waveguide comprises:

a first conductor layer formed on a lower surface of the dielectric substrate;

a second conductor layer formed on an upper surface of the dielectric substrate;

a pair of side wall portions which electrically connect the first conductor layer and the second conductor layer to each other and form side walls of the waveguide on opposite sides thereof; and a feed portion for supplying an input signal to the waveguide, wherein the feed portion comprises:

a feed terminal formed on the lower surface of the dielectric substrate without contacting the first conductor layer;

a single or plurality of first via conductors with lower ends that are connected to the feed terminal;

a first connection pad connected to an upper end(s) of the single or plurality of first via conductors; and a plurality of second via conductors with lower ends that are connected to the first connection pad, wherein a sum total of cross-sectional areas of the plurality of second via conductors taken along a second plane parallel to the lower surface of the dielectric substrate is greater than a sum total of a cross-sectional area(s) of the single or plurality of first via conductors taken along a first plane parallel to the lower surface of the dielectric substrate; and wherein the plurality of second via conductors are arranged at intervals equal to or smaller than ½ of a cutoff wavelength.

2. A waveguide according to claim 1, wherein the number of the plurality of second via conductors is greater than the number of the single or plurality of first via conductors.

3. A waveguide according to claim 1, wherein the pair of side wall portions are composed of a plurality of via conductors for side walls which connect the first conductor layer and the second conductor layer to each other.

4. A waveguide according to claim 1, wherein the plurality of second via conductors are arranged along a circle in a plane of the first connection pad.

5. A waveguide according to claim 1, wherein all the single or plurality of first via conductors and the plurality of second via conductors are circular columnar conductors having the same diameter.

6. A waveguide according to claim 1, wherein the feed portion further comprises a second connection pad and a plurality of third via conductors which are alternatingly connected above the plurality of second via conductors along a height direction of the dielectric substrate, and a sum total of cross-sectional areas of the plurality of third via conductors taken along a third plane parallel to the lower surface of the dielectric substrate is greater than the sum total of cross-sectional areas of the plurality of second via conductors taken along the second plane parallel to the lower surface of the dielectric substrate.

7. A waveguide according to claim 6, wherein the number of the plurality of third via conductors is greater than the number of the plurality of second via conductors and the number of the plurality of second via conductors is greater than the number of single or plurality of first via conductors.

8. A waveguide according to claim 6, wherein the plurality of third via conductors with lower ends that are connected to the second connection pad are arranged at intervals equal to or smaller than ½ of a cutoff wavelength.

9. A waveguide according to claim 8, wherein the plurality of third via conductors with lower ends that are connected to the second connection pad are arranged along a circle in a plane of the second connection pad.

10. A waveguide according to claim 6, wherein all the via conductors are circular columnar conductors having the same diameter.

11. A waveguide according to claim 6, wherein, in a plan view as viewed in the height direction, the first connection pad and the second connection pad are formed to be located at the same position and have circular shapes having the same diameter.

* * * * *